United States Patent [19]

Nagati

[11] 4,426,069

[45] Jan. 17, 1984

[54] METTALURGICAL VESSEL SUSPENSION SYSTEM

[75] Inventor: Rashed N. Nagati, Mars, Pa.

[73] Assignee: Pennsylvania Engineering Corporation, Pittsburgh, Pa.

[21] Appl. No.: 417,141

[22] Filed: Sep. 13, 1982

Related U.S. Application Data

[63] Continuation of Ser. No. 931,415, Aug. 7, 1978, abandoned.

[51] Int. Cl.[3] ..... C21C 5/50

[52] U.S. Cl. ..... 266/246

[58] Field of Search ..... 266/243-247

[56] References Cited

U.S. PATENT DOCUMENTS

| | | | |
|---|---|---|---|
| 1,042,876 | 10/1912 | Blackwood | 266/246 |
| 3,146,983 | 9/1964 | Johnson | 266/246 |
| 3,191,922 | 6/1965 | Puhringer | 266/246 |
| 3,385,588 | 5/1968 | Puxkandl | 266/246 |
| 3,400,922 | 9/1968 | Langlitz | 266/246 |
| 3,497,197 | 2/1970 | Puhringer | 266/246 |
| 3,717,333 | 2/1973 | Valdenazzi | 266/246 |
| 3,820,665 | 6/1974 | Fisher | 266/243 |
| 4,273,316 | 6/1981 | Nagati | 266/246 |
| 4,281,823 | 8/1981 | Enkner et al. | 266/246 |

FOREIGN PATENT DOCUMENTS

| | | | |
|---|---|---|---|
| 329209 | 4/1972 | U.S.S.R. | 266/246 |

*Primary Examiner*—Peter K. Skiff

*Attorney, Agent, or Firm*—Fred Wiviott

[57] ABSTRACT

A molten metal processing vessel is supported on a trunnion ring by a plurality of triangular members and adjustable links. Each triangular member is pivotally connected to the vessel to a clamp ring which engages the upper trunnion ring flange. The links are pivotally connected to the vessel and to a second clamp ring which engages the lower trunnion ring flange. A plurality of disk springs are disposed between the second clamp ring and the trunnion ring.

15 Claims, 6 Drawing Figures

METTALURGICAL VESSEL SUSPENSION SYSTEM

This is a continuation of application Ser. No. 931,415, filed Aug. 7, 1978, now abandoned.

BACKGROUND OF THE INVENTION

One prior art vessel support is disclosed in U.S. Pat. No. 3,146,983 wherein a plurality of links pivotally connect a convertor vessel to the upper trunnion ring flange to support the vessel in a vertical position and to allow differential expansion between the vessel and the ring. However, these links are incapable of supporting the vessel when it is tilted to a generally horizontal position. Accordingly, in such prior art vessel suspension systems, it was necessary to provide a plurality of brackets adjacent the trunnion pin for supporting the vessel while the same was being turned up and turned down.

This invention relates to metallurgical vessels and more specifically, with a system for mounting said vessels to a trunnion ring.

SUMMARY OF THE INVENTION

It is an object of the invention to provide a new and improved support for pneumatic metallurgical vessels.

A further object of the invention is to provide a metallurgical vessel suspension system which supports the vessel in its vertical and tilted positions and permits differential expansion between the vessel and a surrounding trunnion ring.

A further object of the invention is to provide a convertor vessel suspension system wherein mechanical load is relatively uniformly distributed around the trunnion ring.

Still another object of the invention is to provide a support for convertor vessels which does not restrict axial vessel expansion.

These and further objects of the invention will become more apparent from the detailed description of the invention taken with the accompanying drawings.

DESCRIPTION OF THE PREFERRED EMBODIMENTS

Figure 1:
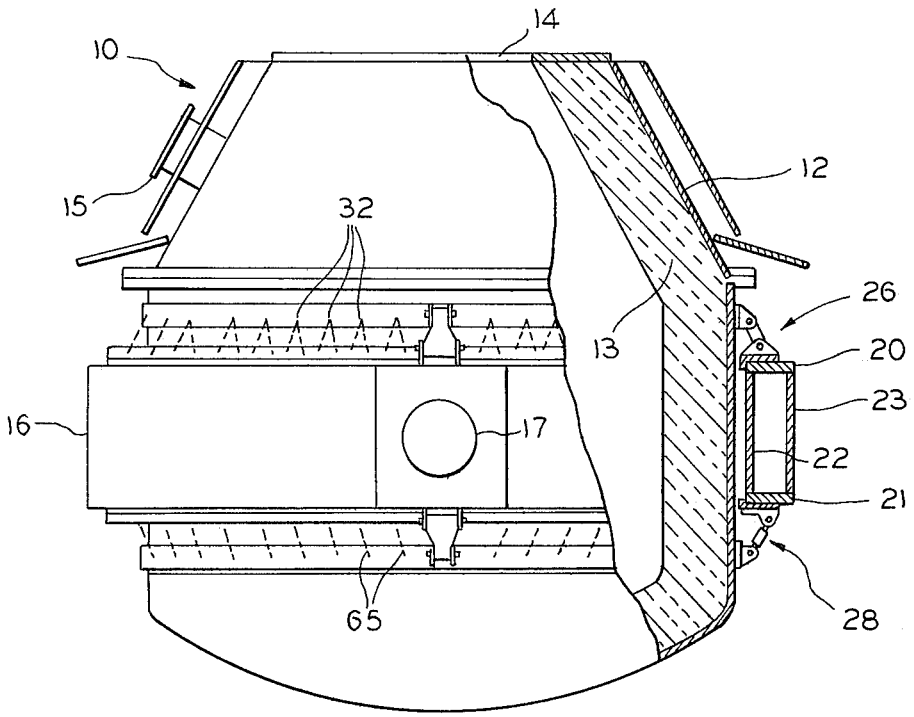
FIG. 1 is a side elevational view with parts broken away schematically illustrating a converter vessel having a suspension system according to the present invention.

FIG. 1 shows a converter vessel 10 which is one example of a metallurgical vessel to which the suspension system according to the present invention is applicable. As those skilled in the art will appreciate, however, the suspension system is applicable to any metallurgical vessel which is supported within a so-called trunnion ring. The vessel 10 is shown to include a metallic shell 12 and a refractory lining 13. A top opening 14 permits charging of the vessel with hot metal or scrap. The vessel 10 may also have a pouring spout 15 which permits the discharge of its contents into a ladle or other suitable receptacle when the vessel is tipped.

As seen in FIG. 1, the vessel 10 is surrounded by a concentric trunnion ring 16. Extending from each of the diametrically operative sides of trunnion ring 16 are a pair of coaxial trunnion pins 17, only one of which is seen in FIG. 1. Pins 17 are usually journaled in suitable supports (not shown) and are coupled to a suitable drive mechanism (not shown) which provides the requisite torque for tilting the trunnion ring 16 and the vessel 10 which it supports. The trunnion pins 17 may also be hollow so as to allow the entry and exit of cooling water to the interior of trunnion ring 16. In the illustrated examples, the interior of trunnion ring 16 is intended to be water-cooled but the specific details of construction are omitted since they are well-known in the art and form no part of the present invention.

Figure 2:
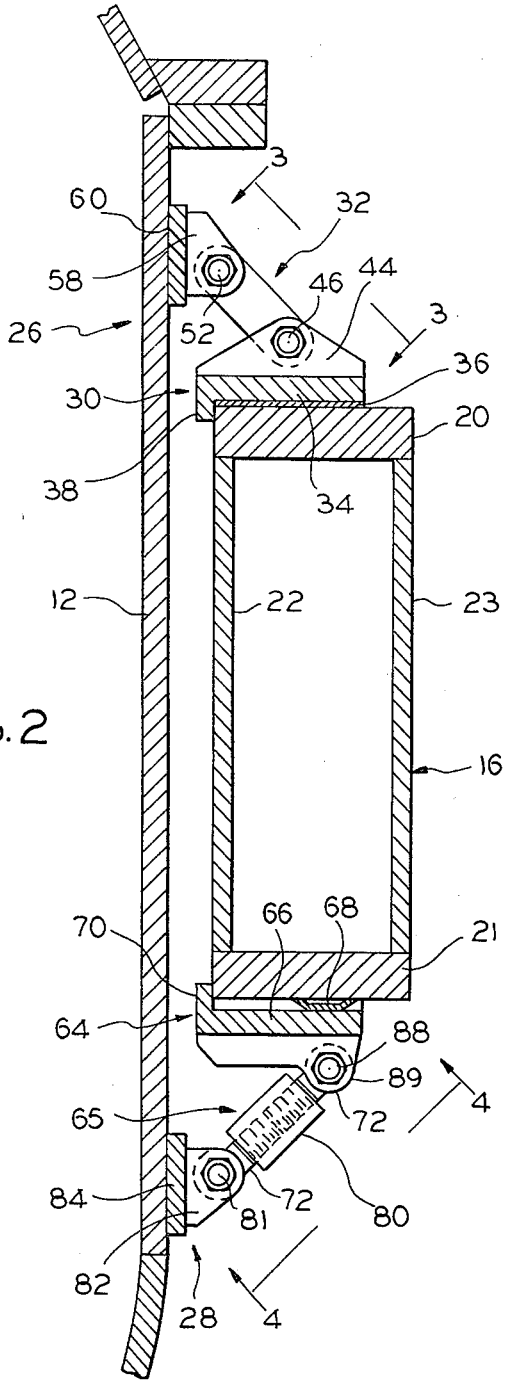
FIG. 2 is a cross-sectional view showing the suspension system of FIG. 1 in greater detail.

Trunnion ring 16 is shown in FIGS. 1 and 2 to include a top ring-like flange 20 and a similar bottom flange 21 which is spaced from top flange 20 and is arranged in a generally concentric parallel relation with respect thereto. The flanges 20 and 21 are joined at their edges by an annular inner wrapper plate 22 and an annular outer wrapper plate 23 which is concentric with wrapper plate 22 and spaced therefrom in a generally parallel relation. The joints between flanges 20 and 21 and wrapper plates 22 and 23 may be secured in any suitable manner such as by welding. It will also be appreciated that trunnion ring 16 in the illustrated example is essentially a hollow, circular box girder. While not shown in the drawings, trunnion ring 16 may also be reinforced internally by a series of circumferentially spaced radially disposed plates each of which has an aperture to permit the circulation of cooling water, if desired. It will also be apparent that the vessel suspension system according to the present invention is applicable whether the trunnion ring 16 has a configuration illustrated in FIGS. 1 and 2 or is in another form such as an I-beam, channel or various other cross-sectional shapes.

The vessel 10 is supported on the trunnion ring 16 by an upper suspension assembly 26 and a lower suspension assembly 28. The upper suspension assembly 26 includes a clamp ring 30 which engages the upper flange 20 and a plurality of generally triangular links 32 which are pivotally connected at their lower ends to the ring 30 and at their upper ends to the vessel 12. Ring 28 is generally co-radial with top flange 20 and may comprise a single member or a plurality of arcuate segments. In transverse cross-section, ring 30 is generally L-shaped with its large leg 34 disposed above and extending parallel to top flange 20. Leg 34 of ring 30 may engage flange 20 directly or a thin metallic shock absorber pad 36 may be disposed therebetween. The shorter leg 38 of clamp ring 30 extends downwardly behind the inner edge of flange 20.

Each link 32 includes a relatively thick base portion 40 which tapers down to a thin neck portion 42. The base portion 40 of each link 32 is pivotally mounted between a pair of upstanding brackets 44 which are affixed in spaced apart relation to the upper surface of clamp ring 30. Specifically, a pivot bolt 46 extends through aligned holes 48 in brackets 44 and a bore 50 extending through base portion 40. The neck portion 42 of each link 32 is similarly pivotally mounted to vessel 10 by means of a pivot bolt 52 extending through bores in neck portion 42 and aligned apertures 56 in brackets 58 which are affixed in parallel, spaced apart relation to a ring 60 secured to the shell 12 generally above trunnion ring 16. The bolts 46 and 52 through each link 32 are generally parallel so that the links may pivot simultaneously at its upper and lower ends relative to clamp ring 30 and vessel shell 12. Also, each of bolts 46 and 52 may be threaded at one end so that they may be suitably retained in position such as by means of nuts 62.

The lower suspension assembly 28 includes a second clamp ring 64 which is configured similarly to the upper clamp ring 30 and a plurality of links 65. The long leg 66 of ring 64 is disposed in a generally parallel relation to the lower flange 21 and there are a plurality of spaced apart disk springs 68 disposed therebetween. The short leg 70 of ring 64 also hooks behind the lower inside edge of flange 21.

Each of the links 65 includes a pair of eye-bolts each of which includes a head portion 74 having a transverse aperture 76 and a threaded shank 78. An internally threaded sleeve 80 engages each of the shanks 78 so that the distance between the apertures 76 and hence, the length of each link 65 may be adjusted. The lower end of each link 65 is pivotally mounted by means of a bolt 81 between a pair of brackets 82 affixed in spaced apart parallel relation to a second ring 84 affixed generally below trunnion ring 16. Bolts 81 extend through apertures 76 and aligned holes 86 in brackets 82. The upper end of each link 65 is similarly pivotally mounted by means of bolts 88 between a second pair of brackets 89 affixed to a lower surface of clamp ring 64. Bolts 88 extend between holes 92 in brackets 88 and through apertures 76 in the upper ends of links 65. The bolts 81 and 88 are arranged in a generally parallel relation to permit simultaneous pivotal movement of links 65 at their opposite ends and each is threaded at one end for being secured by means of nuts 94.

While brackets 58 and 82 are shown in FIG. 2 to have substantially the same height as their respective rings 60 and 84, they may, for added strength, be of increased height and have portions (not shown) which engage and are affixed to the surface of shell 12.

Figure 5:
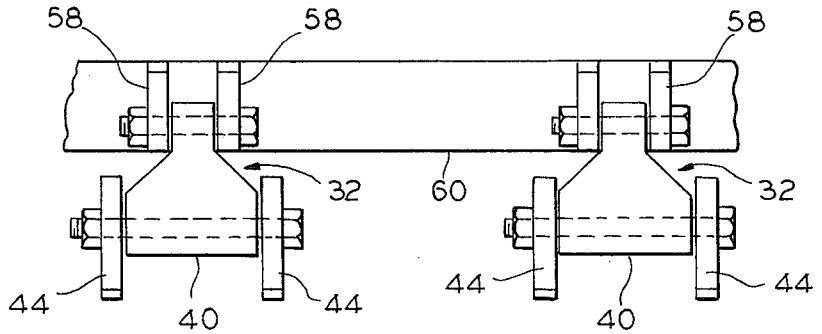
FIG. 5 illustrates one variation of a portion of the suspension assembly according to the invention.
Figure 6:
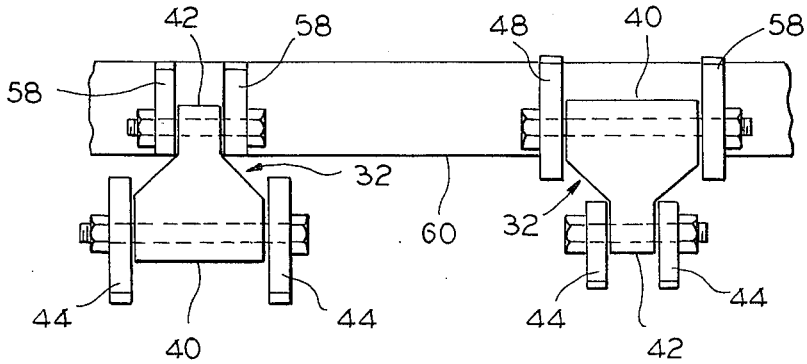
FIG. 6 shows an alternate variation of a portion of the suspension assembly according to the present invention.

In the preferred embodiment of the invention shown in FIG. 5, all of the upper links 32 are arranged such that their relatively larger base portions 40 are attached to upper clamp ring 30 and their relatively smaller neck portions 42 are pivotally connected to ring 60. In the alternate embodiment of the invention shown in FIG. 6, however, alternate links 32 are inverted so that their base portions 40 are pivotally connected to ring 60 while their smaller neck portions 42 are pivotally connected to clamp ring 30.

Figure 3:
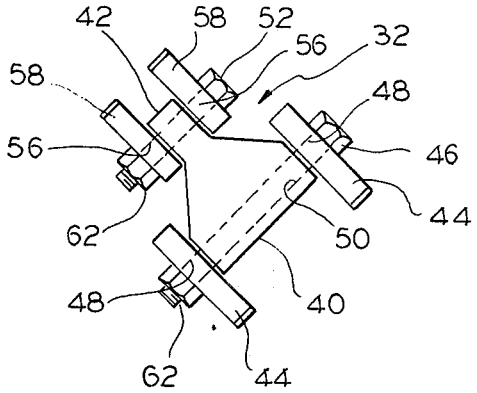
FIG. 3 is a view taken along lines 3—3 of FIG. 2.
Figure 4:
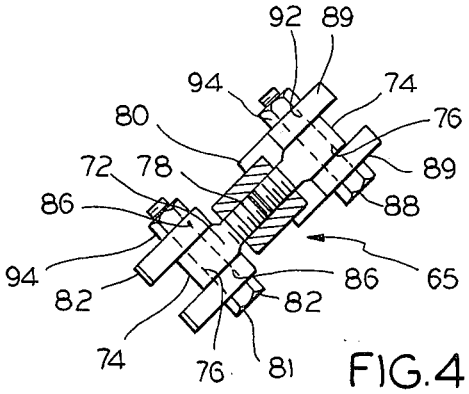
FIG. 4 is a view taken along lines 4—4 of FIG. 2.

It will be appreciated that there are a plurality of links 32 of the upper suspension assembly 26 and a plurality of links 65 of the lower suspension assembly 28 which are disposed in spaced apart relation around the vessel 10 and all are pivotally connected to the vessel shell 12 and to the respective upper and lower clamp rings 30 and 64 in the manner discussed with respect to FIGS. 2–4. This permits differential radial expansion of the vessel 10 and the trunnion ring 16 as the links 32 and 65 are free to pivot at their opposite ends. For example, should the vessel 10 expand radially to a greater degree than trunnion ring 16, thereby moving the shell toward the right relative to trunnion ring 16 as viewed in FIG. 2, the link 32 will tend to pivot clockwise about bolts 52 and 46 and the link 65 will pivot counterclockwise about bolts 81 and 88. Similar pivotal movement in the links 32 and 65 will occur should the vessel grow lengthwise as a result of the temperatures and stresses inherent in its operation. In addition, the links 32 not only support the vessel when it is in a vertical position, but the links 32 and 65 also furnish support for the vessel when it is in its various intermediate tilted positions and when it is turned up and turned down.

The clamp rings 30 and 64 absorb radial loading from the links 32 and 65 so as to minimize radial stress in the trunnion ring flanges 20 and 21. In addition, the clamp rings 30 and 64 distribute the compressive loads relatively evenly to the trunnion ring when the vessel is vertical. Further, the links 32 and 65 prevent lateral shifting of the vessel during turn-up and turn-down. This is particularly enhanced by the upper links 32 which resist sidewise deflection as a result of their generally triangular configuration. The spring washers 68 between the lower clamp ring 64 and trunnion ring 16 permit relative movement between the clamp ring 64 and the trunnion ring 16 so that links may also be used below the trunnion ring for support during tilting and when the vessel is inverted. As a result, brackets employed in prior art systems to support the vessel during turn-up and turn-down is not required. Additionally, the adjustability of links 65 allow changes in length necessitated by changes in vessel dimensions during operation.

While only a few embodiments of the invention have been illustrated and described, it is not intended to be limited thereby but only by the scope of the appended claims.

I claim:

1. A tiltable metallurgical vessel including:

a trunnion support at least partially surrounding said vessel and having upper and lower surfaces first support engaging means abutting the upper surface of said trunnion support and being disconnected therefrom, a first plurality of members disposed in spaced apart relation around said vessel and each being pivotally mounted at one end to said vessel and its other end to said first support engaging means, said first support engaging means distributing the load from said first plurality of members to said trunnion support when said vessel is in an untilted position, a second support engaging means abutting the lower surface of said trunnion support and being disconnected therefrom, a second plurality of members spaced around said vessel and each being pivotally mounted at one end to said vessel and at their other ends to said second support engaging means, said first and second support engaging means absorbing radial loading from said vessel.

2. The vessel set forth in claim 1 and including resilient means disposed between said second support engaging means and the lower surface of said trunnion support.

3. The vessel set forth in claim 2 wherein there is a gap between said second support engaging means and the lower surface of said trunnion support said resilient means being disposed in said gap and comprising spring washers.

4. The vessel set forth in any of claims, 1, 2 or 3 wherein each of said second plurality of members comprises links having a first pivot means pivotally connected to said vessel and a second pivot means pivotally connected to said second support engaging means and means for adjusting the length of said links between their one and other ends.

5. The vessel set forth in any of claims 1, 2 or 3 wherein said trunnion support comprises trunnion ring means, and said first and second support engaging means comprise first and second rings, respectively, each substantially coextensive with said trunnion ring means.

6. The vessel set forth in claim 5 wherein each of said first plurality of members has a relatively thick base portion and a relatively thinner neck portion, a first pivot means disposed in said neck portion and pivotally connected to said vessel and a second pivot means disposed in said base portion and pivotally connected to said first ring, said first and second pivot means being generally parallel to permit simultaneous pivotal movement of said first members relative to said first ring and said vessel.

7. The vessel set forth in claim 6 wherein alternate ones of said first plurality of members are arranged with their base portions pivotally mounted to said first ring and their neck portions pivotally mounted to said vessel and the next adjacent ones of said first plurality of members being arranged with their base portions being pivotally mounted to said vessel and their neck portions pivotally mounted to said first member.

8. The vessel set forth in any one of claim 1 wherein said trunnion support comprises a trunnion ring having upper and lower flanges, said first support engaging means comprises a first ring disposed adjacent to and disconnected from the upper flange of said trunnion ring, and said second support engaging means comprising a second ring disposed adjacent to and disconnected from the lower flange of said trunnion ring, said second ring being spaced from said lower flange, and a plurality of spaced apart spring means being disposed between and engaging said lower flange and said second ring.

9. The vessel set forth in claim 8 wherein each of said first plurality of members has a relatively thick base portion and a relatively thinner neck portion, a first pivot means disposed in said neck portion and pivotally connected to said vessel and second pivot means disposed in said base portion and pivotally connected to said first ring, said pivot means being generally parallel to permit simultaneous pivotal movement of said first members relative to said ring and said vessel.

10. A metallurgical vessel including:

a trunnion ring at least partially surrounding said vessel and having upper and lower surfaces, a first ring member abutting the upper surface of said trunnion ring, a first plurality of pivot members each being disposed in spaced apart relation around said vessel and each being pivotally mounted at one end to said vessel at points spaced above said trunnion ring and its other end to said first ring member, a second ring member abutting the lower surface of said trunnion ring, a second plurality of pivot members spaced around said vessel and each being pivotally mounted at one end to said vessel and at points spaced below said trunion ring and at their other ends to said third member, said first ring member distributing the load from the first plurality of pivot members to said trunnion ring and said first and second ring members absorbing radial loading from said vessel.

11. The vessel set forth in claim 10 wherein each of said second plurality of pivot members comprises links having a first pivot means pivotally connected to said vessel and a second pivot means pivotally connected to said second ring member and means for adjusting the length of each of said links between the pivotal connections thereof with said vessel and second ring member.

12. The vessel set forth in claim 11 wherein there is a gap between said second ring member and the lower surface of said trunnion ring, and a plurality of spring means disposed in said gap and in a spaced apart relation relative one to the other.

13. A metallurgical vessel including:

a trunnion ring at least partially surrounding said vessel and having upper and lower surfaces, said trunnion ring comprising a main ring and a secondary ring abutting said main ring and defining said lower surface, a first plurality of pivot members each being disposed in spaced apart relation around said vessel and each being pivotally mounted at one end to said vessel at points spaced above said trunnion ring and its other end to means engaging said upper surface, a second plurality of pivot members spaced around said vessel and each being pivotally mounted at one end to said vessel and at points spaced below said trunion ring at their other ends to said secondary ring, said trunnion ring being tiltable to tilt said vessel about a generally horizontal axis, said first and second plurality of members being the sole support of said vessel in all tilted positions thereof.

14. The vessel set forth in claim 12 and including resilient means disposed between said main ring and said secondary ring.

15. The vessel set forth in claim 13 wherein there is a gap between said main ring and said secondary ring, said resilient means being disposed in said gap and comprising spring washers.

* * * * *